US010443913B2

(12) United States Patent
Takami et al.

(10) Patent No.: US 10,443,913 B2
(45) Date of Patent: Oct. 15, 2019

(54) REFRIGERATOR AND METHOD FOR CONTROLLING THE SAME

(71) Applicant: Panasonic Corporation, Osaka (JP)

(72) Inventors: Fuminori Takami, Osaka (JP); Terutsugu Segawa, Osaka (JP); Katsunori Horii, Shiga (JP); Hisakazu Sakai, Shiga (JP); Yoshimasa Horio, Shiga (JP)

(73) Assignee: PANASONIC CORPORATION, Osaka (JP)

( * ) Notice: Subject to any disclaimer, the term of this patent is extended or adjusted under 35 U.S.C. 154(b) by 18 days.

(21) Appl. No.: 15/702,663

(22) Filed: Sep. 12, 2017

(65) Prior Publication Data

US 2018/0100678 A1 Apr. 12, 2018

(30) Foreign Application Priority Data

Oct. 11, 2016 (JP) ..... 2016-199639

(51) Int. Cl.
*F25B 47/02* (2006.01)
*F25B 31/00* (2006.01)
(Continued)

(52) U.S. Cl.
CPC ..... *F25B 47/022* (2013.01); *F25B 31/006* (2013.01); *F25B 41/04* (2013.01);
(Continued)

(58) Field of Classification Search
CPC ..... F25B 31/00; F25B 31/006; F25B 41/00; F25B 41/003; F25B 41/04; F25B 41/043;
(Continued)

(56) References Cited

U.S. PATENT DOCUMENTS 4,383,421 A * 5/1983 Quesnoit ..... F25B 5/04 62/333
4,519,214 A * 5/1985 Sano ..... F25B 13/00 62/156
(Continued)

FOREIGN PATENT DOCUMENTS

JP 4-194564 7/1992
JP 2000-304415 11/2000

*Primary Examiner* — Keith M Raymond
*Assistant Examiner* — Gustavo A Hincapie Serna
(74) *Attorney, Agent, or Firm* — McDermott Will & Emery LLP

(57) ABSTRACT

A refrigerator includes: (i) a compressor; (ii) a condenser; (iii) a decompressor; (iv) an evaporator; (v) a first pipe that connects the compressor, the condenser, the decompressor, and the evaporator, and that circulates a refrigerant therein; (vi) a second pipe that causes the refrigerant to circulate from the condenser to the evaporator; and (vii) a switching valve that switches flow of the refrigerant in the first pipe to the second pipe. A method for controlling the refrigerator includes: conducting a normal cooling operation in which a refrigerant is caused to circulate through a compressor, a condenser, decompressor, and an evaporator; and conducting a defrosting operation in which the refrigerant is caused to circulate through the compressor, the condenser, and the evaporator, excluding the decompressor.

9 Claims, 6 Drawing Sheets

(51) Int. Cl.
*F25B 41/04* (2006.01)
*F25B 49/02* (2006.01)

(52) U.S. Cl.
CPC ..... *F25B 49/02* (2013.01); *F25B 2341/0662* (2013.01); *F25B 2400/01* (2013.01); *F25B 2400/0411* (2013.01); *F25B 2400/24* (2013.01); *F25B 2600/0251* (2013.01); *F25B 2600/2501* (2013.01)

(58) Field of Classification Search
CPC ..... F25B 47/00; F25B 47/02; F25B 47/022; F25B 49/00; F25B 49/02; F25B 2341/066; F25B 2341/0662; F25B 2400/01; F25B 2400/04; F25B 2400/24; F25B 2400/0411; F25B 2400/24; F25B 2600/0251; F25B 2600/2501; F25D 21/00
USPC ..... 62/80, 81
See application file for complete search history.

(56) References Cited

U.S. PATENT DOCUMENTS 6,449,967 B1 * 9/2002 Dube ..... F25B 5/02 62/156
7,168,262 B2 * 1/2007 Hirano ..... F25B 47/022 62/352
7,290,600 B2 * 11/2007 Gavula ..... F25B 13/00 165/231
8,006,506 B2 * 8/2011 Park ..... F25B 13/00 62/151
8,677,772 B2 * 3/2014 Shih ..... B60H 1/00278 62/186
9,759,475 B2 * 9/2017 Iwasaki ..... F24F 1/06
2013/0145785 A1 * 6/2013 Nobuhiro ..... F25B 49/02 62/160
2014/0345310 A1 * 11/2014 Tamaki ..... F25B 13/00 62/238.6
2015/0354864 A1 * 12/2015 Katayama ..... B60H 1/00921 62/238.7
2016/0209088 A1 * 7/2016 Shimazu ..... F25B 31/004
2017/0211861 A1 * 7/2017 Liu ..... F25B 13/00
2017/0219254 A1 * 8/2017 Sul ..... F25B 5/02
2018/0209697 A1 * 7/2018 Nishida ..... F25B 47/02

* cited by examiner

REFRIGERATOR AND METHOD FOR CONTROLLING THE SAME

TECHNICAL FIELD

The technical field relates to a refrigerator. In particular, the technical field relates to a refrigerator reduces amounts of power consumption in a compressor and a defrosting heater.

BACKGROUND

As an example of a conventional method for reducing an amount of power consumption during the defrosting process in a refrigerator, a method in which exhaust heat generated in a compressor is accumulated in a liquid such as water, and the accumulated heat is circulated in the refrigerator through a pipe in a system other than the system of the cooling pipe, based on a pump, during the defrosting process, thereby defrosting an evaporator has been described in, for example, JP-A-2000-304415. FIG. 5 is a configuration diagram that shows the conventional way of reducing a power consumption in a defrosting heater described in JP-A-2000-304415.

In FIG. 5, a jacket 31 that a heat-accumulation agent is filled into is provided to cover a compressor 30 for compressing a refrigerant, and a pipe 32 for circuiting the heat-accumulation agent is connected to the jacket 31. A circulation pump 33, a heat-accumulation tank 34, and an electromagnetic valve 35 are connected to the pipe 32 in sequence, and thus, a closed system is formed therein. A defrosting chamber-circulation pipe 36 is connected to the circulation pump 33 and the electromagnetic valve 35 to be located between these members, and thus, a closed system is also formed therein.

In addition, an auxiliary heater 37 is provided around the heat-accumulation tank 34. Additionally, a three-way switching valve is used for the electromagnetic valve 35.

During cooling operation of the refrigerator, the electromagnetic valve 35 is opened to cause the heat-accumulation tank 34 and the jacket 31 to communicate with each other, and, a heat-accumulation agent (liquid such as water) is caused to circulate through the pipe 32 based on the circulation pump 33. The heat-accumulation agent is heated in the jacket 31 due to heat production in the compressor 30, the temperature of the heat-accumulation agent inside the heat-accumulation tank 34 is also gradually elevated. Accordingly, the exhaust heat produced in the compressor 30 is accumulated in the heat-accumulation tank 34.

When the refrigerator is switched to a defrosting-operation mode, the compressor 30 is switched off, the electromagnetic valve 35 is opened toward the chamber-circulation pipe 36, and the circulation pump 33 is activated to thereby cause the heat-accumulation agent to circulate through the chamber-circulation pipe 36, thereby carrying out the defrosting process. As needed, the auxiliary heater 37 is switched on to maintain the temperature of the heat-accumulation agent.

As another example of a conventional method for reducing an amount of power consumption in a defrosting heater in a refrigerator, a method in which a refrigerant is regurgitated from the compressor is described in, for example, JP-A-4-194564. FIG. 6 is a configuration view of a refrigeration cycle snowing the conventional method for reducing an amount of power consumption in a defrosting heater described in JP-A-4-194564. The arrows show a flow direction of the refrigerant (during the cooling operation).

The refrigeration cycle in FIG. 6 is configured by a compressor 43, a condenser 44, a capillary tube 45, and two evaporators (an evaporator 40, and an evaporator 42). A differential-pressure valve 46 is provided between the condenser 44 and the capillary tube 45, and an electromagnetic valve 41 is provided between the evaporator 40 and the evaporator 42.

During the normal cooling operation, the electromagnetic valve 41 is opened, and the refrigerant is caused to circulate therein while the pressure of the refrigerant is controlled based on the differential-pressure valve 46.

During the defrosting process (in which the compressor is switched off) the electromagnetic valve 41 is closed, and also, the differential-pressure valve 46 is closed. Accordingly, the high-pressure refrigerant gas regaining within the compressor 43 is regurgitated and flowed into the low-pressure evaporator 42, due to the pressure difference. Based on latent heat of condensation of the refrigerant gas, the defrosting process is carried out.

Furthermore, in general, compressors for compressing a refrigerant will exhibit reduced operation efficiencies when a suction temperature of the refrigerant becomes high, and therefore, such reduced operation efficiencies are suppressed based on an air-cooling or water-cooling system.

SUMMARY

However, the compressor 30 is covered with the jacket 31 that the heat-accumulation agent has been filled into, in the conventional structure disclosed in JP-A-2000-304415. Therefore, heat release in the compressor 30 is impeded. Consequently, the temperature of the compressor 30 would be elevated, and thus, the operation efficiencies would be deteriorated. As a result, the power consumption would be increased during the normal cooling operation.

Furthermore, since the heat-accumulation agent is circulated in the other system, a space for the heat-accumulation tank 34, the circulation pump 33, the pipe 32, the chamber-circulation pipe 36, etc. is required. Thus, a storage capacity of the refrigerator will be reduced.

Furthermore, in the conventional structure disclosed in JP-A-4-194564, the high-pressure refrigerant gas is caused to regurgitate through a valve that is used for preventing the regurgitation within the compressor 43. Therefore, it is difficult to adjust the flow rate. Additionally, a problem of reductions in the amount of the flowing high-pressure refrigerant gas can also be mentioned. As a result, it is impossible to sufficiently reduce the amount of power consumption in the defrosting heater.

The disclosure solves the above-mentioned problems in the conventional arts. An object of the disclosure is to provide a small-sized refrigerator that reduces an amount of power consumption, and a method for controlling the same.

In order to achieve the above object, according to one aspect of the disclosure, a refrigerator, includes: (i) a compressor; (ii) a condenser; (iii) a decompressor; (iv) an evaporator; (v) a first pipe that connects the compressor, the condenser, the decompressor, and the evaporator, and that circulates a refrigerant therein; (vi) a second pipe that causes the refrigerant to circulate from the condenser to the evaporator; and (vii) a switching valve that switches flow of the refrigerant in the first pipe to the second pipe.

Furthermore, according to another aspect of the disclosure, a method for controlling a refrigerator includes: conducting a normal cooling operation in which a refrigerant is caused to circulate through a compressor, a condenser, decompressor, and an evaporator; and conducting a defrosting operation in which the refrigerant is caused to circulate through the compressor, the condenser, and the evaporator, excluding the decompressor.

According to the the refrigerator of the disclosure, it becomes possible to remarkably reduce power consumption in the compressor and the defrosting heater.

DESCRIPTION OF EMBODIMENTS

Hereinafter, embodiments will be described with reference to the drawings.

(First Embodiment)

Figure 1:
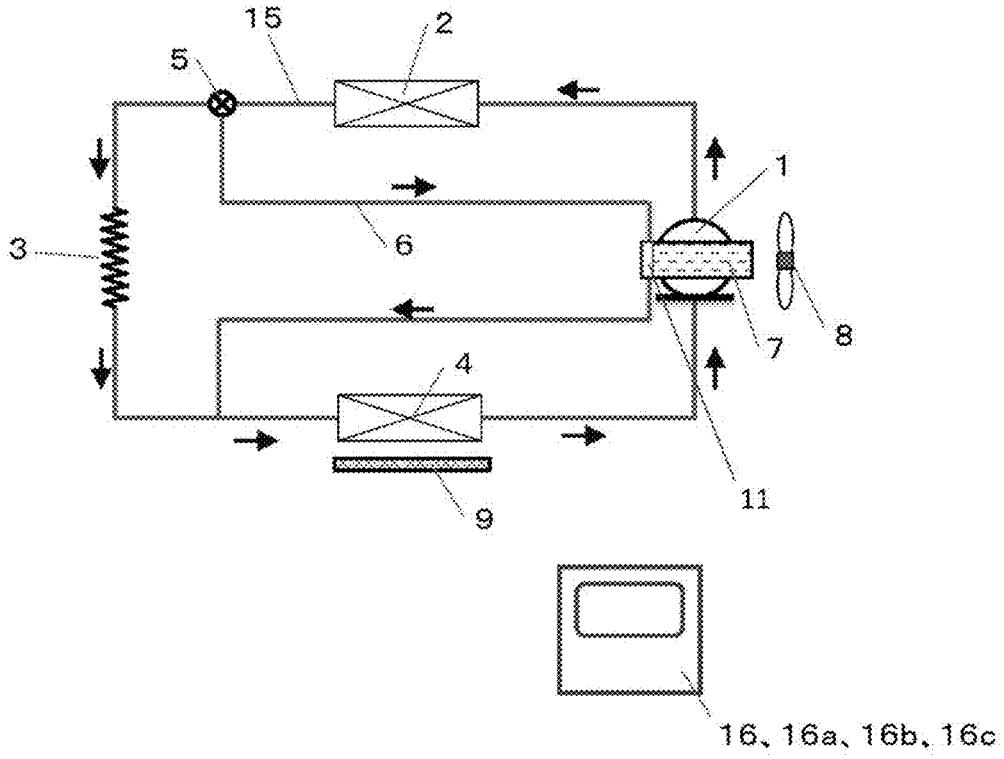
FIG. 1 is a diagram showing a configuration of a refrigeration cycle in a first embodiment.

FIG. 1 is a schematic view of pipes in the refrigeration cycle in the first embodiment of the disclosure.

In FIG. 1, a compressor 1, a condenser 2, a decompressor 3 (a capillary tube), and an evaporator 4 are provided in sequence along a first pipe 15 through which a refrigerant is circulated. The arrows snow a flow direction of the refrigerant. Additionally, at least one control unit 16 that controls the entire system is provided. The control unit 16 may include multiple control units, i.e., a first control unit 16*a*, a second control unit 16*b*, a third control unit 16*c*, etc.

The compressor 1 has a role in compressing a gas-phase refrigerant within the refrigeration cycle while causing the refrigerant to circulate within the refrigeration cycle.

The condenser 2 condenses and liquefies the compressed gas-phase refrigerant, and thus, causes latent heat of the refrigerant condensation to release.

The decompressor 3 (capillary tube) reduces the pressure of the liquid-phase refrigerant.

The evaporator 4 vaporizes the decompressed liquid-phase refrigerant, and thus, the evaporator 4 is deprived of latent heat of vaporization of the refrigerant. In this way, the cooling process is carried out in the evaporator 4.

A switching valve 5 is provided between the condenser 2 and the decompressor 3 (capillary tube). Based on the switching valve 5, the flow direction of the refrigerant can be switched toward the second pipe 6.

Based on the switching valve 5, the flow direction of the refrigerant that comes out of the condenser 2 (the flow in the first pipe 15) is switched toward the second pipe 6. Thus, the second pipe 6 forms a flow passage that makes it possible to deliver the refrigerant to the compressor 1.

Additionally, a heat-release member 7 is attached onto the surface of the shell of the compressor 1. The second pipe 6 passes through the heat-release member 7, and is connected to an inlet of the evaporator 4.

In order to promote diffusion of heat generated through operation of the compressor 1, the heat-release member 7 is formed as a member that has a large surface area and that is located on the surface of the shell of the compressor 1. The heat-release member 7 may be a heat-release fin or the like.

Furthermore, in order to suppress elevation in the temperature of the compressor 1 due to heat produced during operation of the compressor 1, a cooling fan 8 for blowing the air toward the compressor 1 is provided around the compressor 1.

In the vicinity of the evaporator 4, a heater 9 that generates heat when it is switched on is provided. The heater 9 heats the evaporator 4, and thus, melts frosts adhering onto the surface of the evaporator 4.

<Heat-Release Member 7>

Figure 2A:
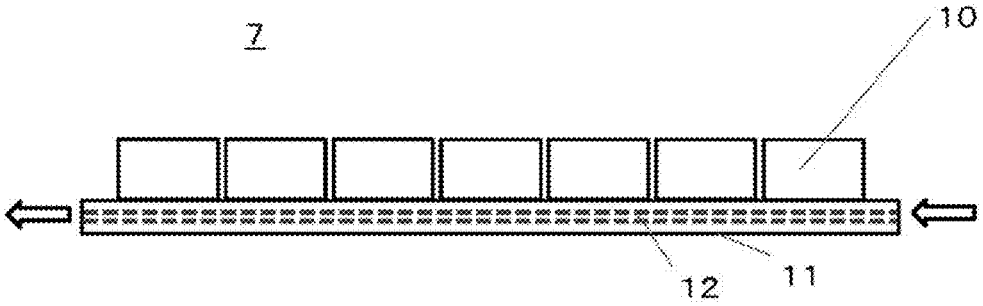
FIG. 2A is a lateral view of a heat-release member in the first embodiment.
Figure 2B:
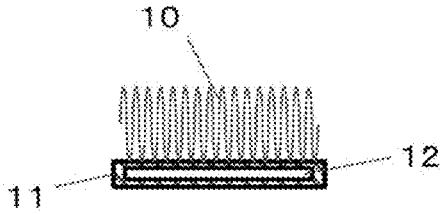
FIG. 2B is a front view of the heat-release member in the first embodiment.

FIGS. 2A and 2B show one example of a structure of the heat-release member 7 in which fins and a tube are employed. FIG. 2A is a lateral view of the heat-release member 7. FIG. 2B is a front view of the heat-release member 7. The arrows show a flow direction of the refrigerant.

The tube 11 in which the third pipe 12 is provided is attached to the heat-release fins 10 with a wax. The third pipe 12 is connected to the second pipe 6.

In this embodiment, the third pipe 12 is configured to have a rectangular cross-section formed by the tube 11. However, the third pipe 12 may be configured by providing a recessed/projecting part on the inner area of the tube 11, so as to have a larger surface area in the inner part of the third pipe 12.

Figure 3A:
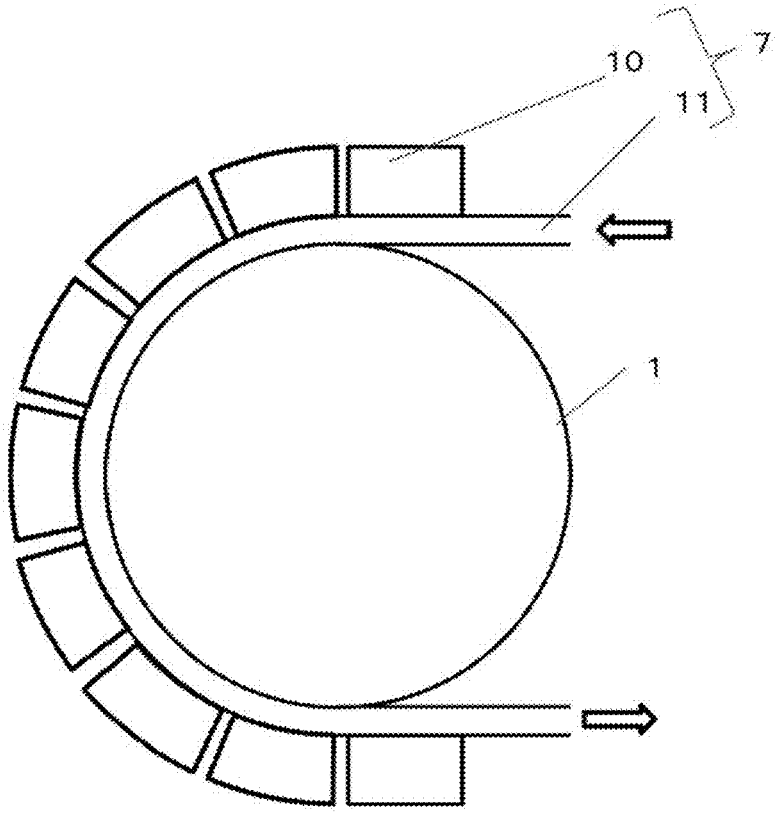
FIG. 3A is a plan view of a compressor and the heat-release member in the first embodiment.
Figure 3B:
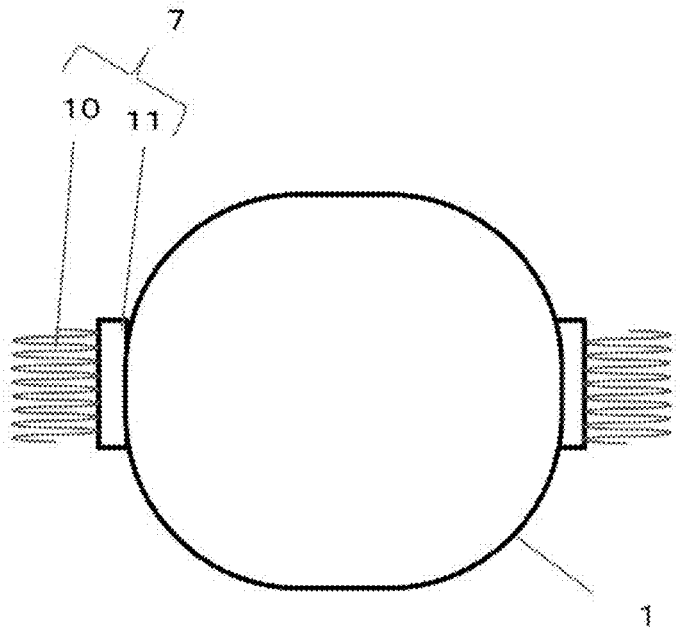
FIG. 3B is a lateral view of the compressor and the heat-release member in the first embodiment.

In FIGS. 3A and 3B, one example of a structure in which the heat-release member 7 is placed on the compressor 1 is shown. The arrows show a flow direction of the refrigerant.

FIG. 3A is a plan view of the heat-release member 7 and the compressor 1. FIG. 3B is a lateral view of the heat-release member 7 and the compressor 1.

The heat-release member 7 and the compressor 1 are provided in a unified manner in which the heat-release member 7 is wound around the lateral surface of the shell of the compressor 1. The heat-release member 7 and the compressor 1 are preferably provided in such a unified manner to secure sufficient heat conductance. Moreover, the fins 10 are preferably provided in parallel to the blast caused by the cooling fan 8. Furthermore, the fins 10 are preferably arranged to be vertical to the natural convection when the cooling fan 8 is switched off. This is because such arrangement of the fins 10 is preferable in order to secure favorable neat-release during the operation of the cooling fan 8 for the compressor 1 and favorable heat accumulation during the halt of operation of the cooling fan 8.

<Operation>

In the refrigeration cycle configured in the above-described manner, during the normal cooling operation, the gas-phase refrigerant is compressed in the compressor 1 while the refrigerant is delivered into the refrigeration cycle. Then, the compressed gas-phase refrigerant is condensed and liquefied in the condenser 2, and thus, latent heat of the refrigerant condensation is released therefrom. Subsequently, the pressure of the liquid-phase refrigerant is reduced in the decompressor 3 (capillary tube), and then, the decompressed liquid-phase refrigerant is vaporized in the evaporator 4. Accordingly, the evaporator 4 is deprived of the latent heat of the vaporization of the refrigerant.

Based on the above-described procedures, heat-exchange is carried out between the cooled evaporator 4 and the air around it by use of a fan (not shown in the figures) that causes the air to circulate toward the surface of the evaporator 4, and thus, the air is circulated inside the freezing chamber/refrigeration chamber, thereby freezing/refrigerating foods for storage. In this case, the cooling fan 8 is activated to suppress elevation of the temperature of the compressor 1.

If the cooling operation is continued, water deprived from food adheres onto the evaporator 4, and grows as frost thereon. The heat-exchange performance of the evaporator 4 would be deteriorated depending on the growth of frost. Therefore, the compressor 1 is temporarily switched off to halt the cooling operation, and then, the defrosting operation is carried out, in order to reset the deteriorated heat-exchange performance of the evaporator 4.

Figure 4:
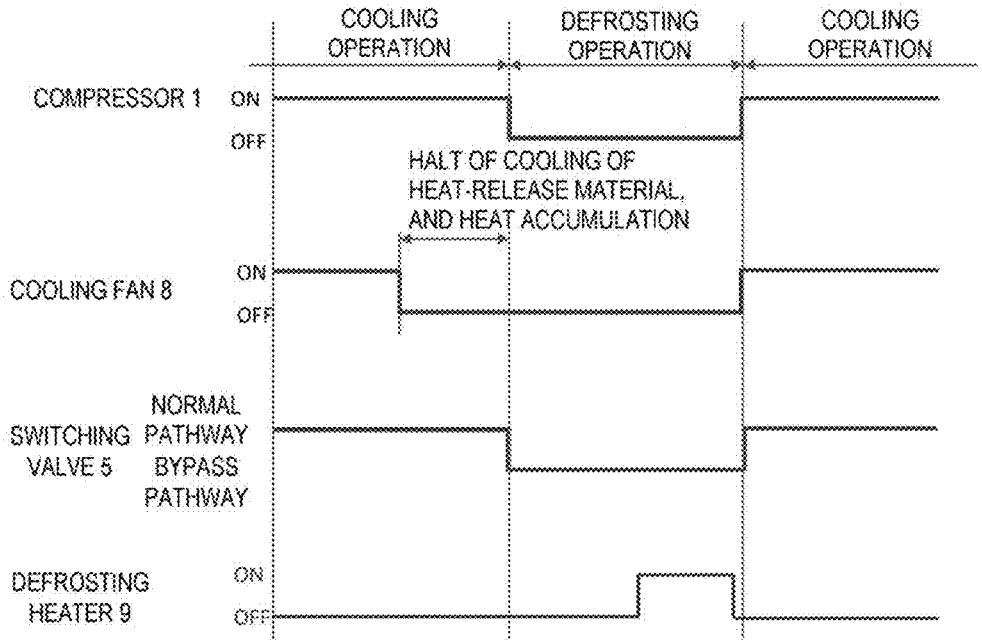
FIG. 4 is a diagram that represents relationships of control among members included in in the first embodiment.
Figure 5:
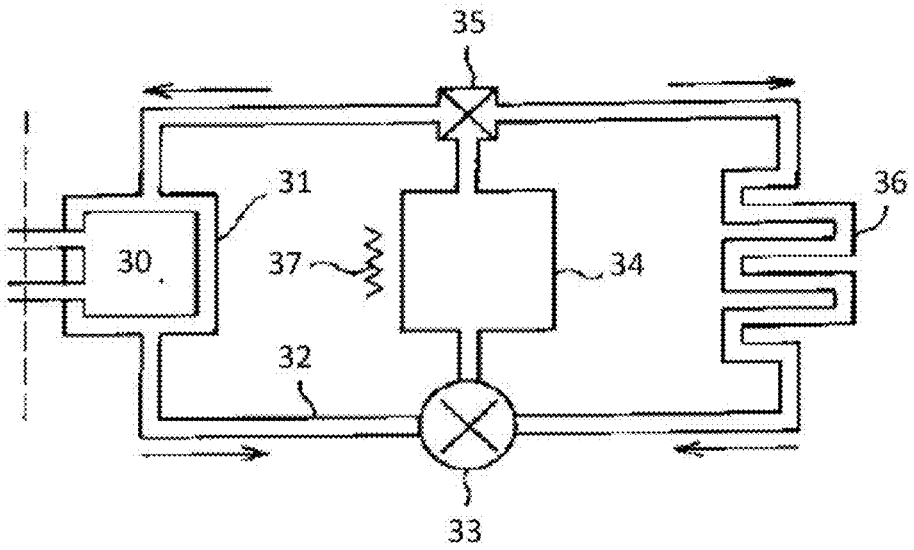
FIG. 5 PRIOR ART
FIG. 5 is a configuration diagram that shows a conventional pathway for a heat-accumulation agent described in JP-A-2000-304415.
Figure 6:
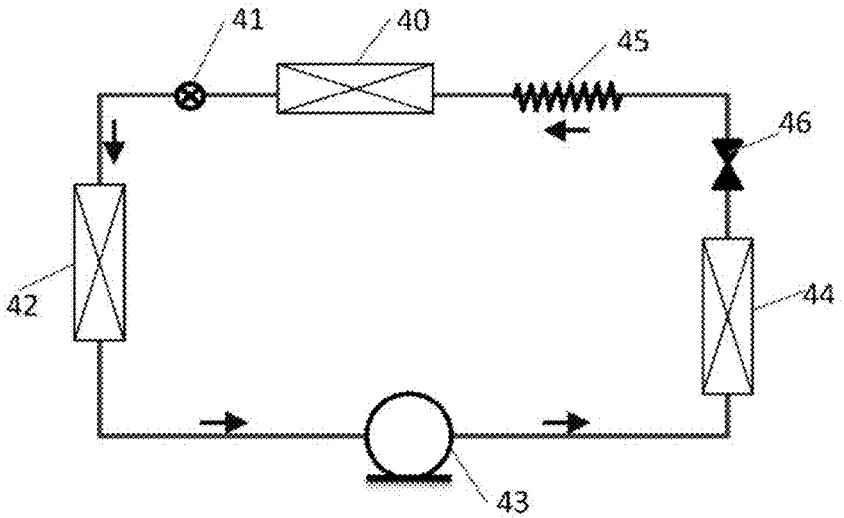
FIG. 6 PRIOR ART
FIG. 6 is a diagram that shows a configuration of a conventional refrigeration cycle described in JP-A-4-194564.

A state of the defrosting operation in this embodiment is described in FIG. 4. As an operation prior to the defrosting operation, based on the first control unit 16*a*, the cooling fan 8 is switched off before the halt of the cooling operation, i.e., before switching off the compressor 1. Based on this operation, heat release in the compressor 1 and the heat-release member 7 is suppressed. As a result, the heat can be accumulated in the compressor 1 and the heat-release member 7.

Subsequently, based on the second control unit 16*b*, simultaneously with the halt of operation of the compressor 1, the flow direction of the refrigerant is switched from the first pipe 15 toward the second pipe 6 by use of the switching valve 5. In this way, the refrigerant is caused to flow through the second pipe 6. By switching the flow direction in this manner, the refrigerant is caused to pass through the third pipe 12 formed in the heat-release member 7. The heat accumulated in the compressor 1 and the heat-release member 7 is transferred to the refrigerant to vaporize the refrigerant. The resulting gas-phase refrigerant is caused to flow through the evaporator 4, and thus, condensed inside the evaporator 4 to heat the evaporator 4. Thus, the heat is employed for melting frosts adhering onto the evaporator 4.

Subsequently, based on the third control unit 16*c*, the defrosting heater 9 is switched on, and thus, the frosts present on the evaporator 4 are completely melted. Then, the defrosting heater 9 is switched off to halt the defrosting operation.

Subsequently, by use of the switching valve 5, the flow passage toward the second pipe 6 is closed, and is switched to the normal circuit. Then, the compressor 1 and the cooling fan 8 are activated to reinitiate the normal operation.

In addition, both of the second control unit 16*b* and the first control unit 16*a* may be arranged as one control unit 16.

<Advantages>

According to the above structure, by using the second pipe 6 that is connected to the the switching valve 5 in parallel to the compressor 3 (capillary tube), it becomes possible to prevent reductions in the amount of the refrigerant supplied to the evaporator, which had been caused due to the reverse flow in the conventional compressor. Furthermore, by disposing the second pipe 6 inside the wall of the refrigeration, reductions in the storage capacity, which had been caused in the circulation of the heat-accumulation agent in the conventional separate system, can be prevented since any additional circulation pipes are not disposed inside the refrigerator according to the disclosure, and also, the time for switching on the defrosting heater 9, and the output power of the defrosting heater 9 can be reduced, thereby reducing the power consumption required for the defrosting process.

Furthermore, based on the cooling operation prior to the defrosting operation, and the control of the defrosting operation, the shell of the compressor is cooled by way of forcible cooling operation using a fan, and the suction temperature is decreased, and operation efficiencies of the compressor is increased, thereby reducing the power consumption. In the defrosting operation, the fan is switched off to increase the temperature of the shell of the compressor. Accordingly, it becomes possible to improve the efficiencies of heat-exchange with the refrigerant supplied to the evaporator, and to increase the amount of the supplied heat.

In addition, although the heat-release member 7 is not an indispensable element, the presence of the heat-release member 7 is preferable. Additionally, although it is not required that the second pipe 6 passes through the heat-release member 7 or the compressor 1, such a structure is one of preferable examples.

A refrigerator according to the disclosure has effects to reduce power consumption based on improving the operation efficiencies of the compressor during the cooling operation, and effects to reduce the power consumption in the defrosting heater based on utilization of the exhaust heat in the shell of the compressor. Therefore, the refrigerator according to the disclosure can be employed for reducing power consumptions in various types of household and professional-use freezing apparatuses.

What is claimed is:

1. A refrigerator, comprising:

a compressor;

a condenser;

a decompressor;

an evaporator;

a first pipe that connects the compressor, the condenser, the decompressor, and the evaporator, and that circulates a refrigerant therein;

a second pipe, through which the refrigerant flows; and a switching valve configure to switch flow of the refrigerant in the first pipe to the second pipe, wherein the second pipe is connected between the switching valve and a connection point on the first pipe located between the decompressor and the evaporator, and a portion of the second pipe conducts heat-exchange with the compressor.

2. The refrigerator according to claim 1, wherein the second pipe is disposed in parallel to the decompressor.

3. The refrigerator according to claim 1, wherein the switching valve is located downstream of the condenser, and switches flow of the refrigerant toward the decompressor or the second pipe.

4. A refrigerator, comprising:

a compressor;

a condenser;

a decompressor;

an evaporator;

a first pipe that connects the compressor, the condenser, the decompressor, and the evaporator, and that circulates a refrigerant therein;

a second pipe, through which the refrigerant flows;

a switching valve configure to switch flow of the refrigerant in the first pipe to the second pipe; and a heat-release member that includes a refrigerant flow channel provided on a surface of a shell of the compressor, wherein the heat-release member is connected to the second pipe, wherein the second pipe is connected between the switching valve and a connection point on the first pipe located between the decompressor and the evaporator.

5. The refrigerator according to claim 4, wherein a third pipe is located between the heat-release member and the compressor.

6. The refrigerator according to claim 4, further comprising a cooling fan that cools the heat-release member.

7. The refrigerator according to claim 1, further comprising a controller that controls the refrigerator in such a manner that, in defrosting the evaporator, the compressor is switched off, the switching valve is opened toward the second pipe, a high-pressure refrigerant remaining in the condenser is heated based on the compressor, and then, said heated refrigerant is supplied to the evaporator.

8. The refrigerator according to claim 6, further comprising a controller that controls the refrigerator in such a manner that, before defrosting the evaporator and during operation of the compressor in a cooling operation, the cooling fan is switched off to suppress heat release in the compressor and the heat-release member, thereby accumulating heat in the compressor and the heat-release member.

9. A method for controlling a refrigerator, comprising:

conducting a normal cooling operation in which a refrigerant is caused to circulate through a compressor, a condenser, decompressor, and an evaporator; and conducting a defrosting operation in which the refrigerant is caused to circulate through the compressor, the condenser, and the evaporator, excluding the decompressor, wherein:

the refrigerator comprises:

a first pipe that connects the compressor, the condenser, the decompressor, and the evaporator, and that circulates a refrigerant therein;

a second pipe, through which the refrigerant flows;

a switching valve configure to switch flow of the refrigerant in the first pipe to the second pipe;

a heat release member that includes a refrigerant flow channel provided on a surface of a shell of the compressor, and is connected to the second pipe; and a cooling fan that cools the heat-release member, and the defrosting operation comprises:

before defrosting the evaporator and during operation of the compressor in a cooling operation, switching off the cooling fan to suppress heat release in the compressor and the heat-release member, thereby accumulating heat in the compressor and the heat-release member; and in defrosting the evaporator, switching off the compressor, opening the switching valve toward the second pipe, heating a high-pressure refrigerant remaining in the condenser based on the compressor, and then, supplying the heated refrigerant to the evaporator.

* * * * *